US010480522B2

(12) United States Patent
Zheng

(10) Patent No.: US 10,480,522 B2
(45) Date of Patent: Nov. 19, 2019

(54) ABRASION-RESISTANT THRUST RING FOR USE WITH A DOWNHOLE ELECTRICAL SUBMERSIBLE PUMP

(71) Applicant: HALLIBURTON ENERGY SERVICES, INC., Houston, TX (US)

(72) Inventor: Dezhi Zheng, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 372 days.

(21) Appl. No.: 14/908,376

(22) PCT Filed: Oct. 14, 2014

(86) PCT No.: PCT/US2014/060484
§ 371 (c)(1),
(2) Date: Jan. 28, 2016

(87) PCT Pub. No.: WO2016/060649
PCT Pub. Date: Apr. 21, 2016

(65) Prior Publication Data
US 2016/0258441 A1 Sep. 8, 2016

(51) Int. Cl.
*F04D 29/04* (2006.01)
*F04D 29/041* (2006.01)
(Continued)

(52) U.S. Cl.
CPC ..... *F04D 29/041* (2013.01); *E21B 43/128* (2013.01); *F04D 1/06* (2013.01);
(Continued)

(58) Field of Classification Search
CPC ..... F04D 13/10; F04D 13/08; F04D 29/026; F04D 29/0465; F04D 29/047;
(Continued)

(56) References Cited

U.S. PATENT DOCUMENTS 3,265,001 A * 8/1966 Deters ..... F04D 13/10 415/68
4,872,808 A * 10/1989 Wilson ..... F04D 13/10 415/170.1
(Continued)

FOREIGN PATENT DOCUMENTS

WO 2011097341 A1 8/2011

OTHER PUBLICATIONS

Sliney, Harold and DellaCorte, Christopher, The Friction and Wear of Ceramic/Ceramic and Ceramic/Metal Combinations in Sliding Contact, Oct. 1993, NASA Lewis Research Center, 1-16.*
(Continued)

*Primary Examiner* — Justin D Seabe
*Assistant Examiner* — Joshua R Beebe
(74) *Attorney, Agent, or Firm* — John W. Wustenberg; Baker Botts L.L.P.

(57) ABSTRACT

A multi-stage pump stack is disclosed herein wherein the multi-stage pump stack comprises a shaft, a diffuser disposed about the shaft, an impeller disposed within the diffuser, a first thrust ring disposed adjacent to the impeller, and a second thrust ring disposed adjacent to the diffuser. The first and second thrust rings are comprised of a material with a low friction coefficient. Systems and methods for distributing forces in the multi-stage pump stack are also disclosed herein.

13 Claims, 4 Drawing Sheets

(51) Int. Cl.

| | |
|---|---|
| ***E21B 43/12*** | (2006.01) |
| ***F04D 1/06*** | (2006.01) |
| ***F04D 7/04*** | (2006.01) |
| ***F04D 29/043*** | (2006.01) |
| ***F04D 29/22*** | (2006.01) |
| ***F04D 29/44*** | (2006.01) |

(52) U.S. Cl.
CPC ..... *F04D 7/04* (2013.01); *F04D 29/043* (2013.01); *F04D 29/22* (2013.01); *F04D 29/445* (2013.01)

(58) Field of Classification Search
CPC ..... F04D 29/0473; F04D 29/051; F04D 29/0513; F04D 29/056; F04D 29/0566; F04D 1/06; F04D 29/043; F04D 29/041; F04D 29/04; F04D 29/22; F04D 29/445; F04D 7/04; F05D 2300/20; F05D 2300/222; F05D 2300/224; F05D 2300/226; F05D 2300/2261; F05D 2220/20; F05D 2240/52; F16C 17/045; F16C 33/1065; F16C 33/106; F16C 33/107; F16C 33/043; F16C 33/04; E21B 43/128
See application file for complete search history.

(56) References Cited

U.S. PATENT DOCUMENTS 5,076,716 A * 12/1991 Mizobuchi ..... B24C 1/04 384/123
5,765,950 A * 6/1998 Eno ..... F04D 29/0413 384/368
5,820,271 A * 10/1998 Hackett, Jr. ..... F16C 17/08 384/425
6,398,493 B1 * 6/2002 Chien ..... F04D 29/026 415/199.2
2004/0080224 A1 4/2004 Knox et al.
2004/0258518 A1 * 12/2004 Buchanan ..... F04D 13/10 415/199.2
2006/0204359 A1 * 9/2006 Semple ..... F04D 1/063 415/170.1
2011/0024198 A1 * 2/2011 Dick ..... E21B 4/003 175/371
2012/0257985 A1 * 10/2012 Parmeter ..... F04D 13/10 417/53
2012/0269614 A1 * 10/2012 Bassett ..... F04D 3/02 415/73
2013/0105156 A1 * 5/2013 Bara ..... F04D 13/10 166/272.3
2014/0262259 A1 * 9/2014 Fouillard ..... E21B 43/126 166/272.3

OTHER PUBLICATIONS

International Search Report and Written Opinion issued in related PCT Application No. PCT/US2014/060484, dated Jul. 15, 2015 (16 pages).
International Preliminary Report on Patentability issued in related Application No. PCT/US2014/060484, dated Apr. 7, 2017 (12 pages).

* cited by examiner

ABRASION-RESISTANT THRUST RING FOR USE WITH A DOWNHOLE ELECTRICAL SUBMERSIBLE PUMP

CROSS-REFERENCE TO RELATED APPLICATION

The present application is a U.S. National Stage Application of International Application No. PCT/US2014/060484 filed Oct. 14, 2014, which is incorporated herein by reference in its entirety for all purposes.

BACKGROUND

Hydrocarbons, such as oil and gas, are commonly obtained from subterranean formations that may be located onshore or offshore. The development of subterranean operations and the processes involved in removing hydrocarbons from a subterranean formation typically involve a number of different steps such as drilling a wellbore at a desired well site, treating the wellbore to optimize production of hydrocarbons, performing the necessary steps to produce the hydrocarbons from the subterranean formation, and pumping the hydrocarbons to the surface of the earth.

When performing subterranean operations, electrical submersible pumps (ESPs) may be used when reservoir pressure alone is insufficient to produce hydrocarbons from a well. An ESP may be installed on the end of a tubing string and inserted into a completed wellbore below the level of the hydrocarbon reservoir. An ESP may employ a centrifugal pump driven by an electric motor to draw reservoir fluids into the pump and to the surface.

However, there are several problems connected with the use of downhole pumps. Specifically, axial forces may be transmitted to the pump shaft. This generally results in premature failure of the submerged pump. Previous attempts to solve this issue included the use of a thrust bearing in the protector section of the ESP. In this solution, the operation range of the ESP is limited by the load capacity of the thrust bearing.

A solution is needed such that ESPs can generate more load without wearing out.

BRIEF DESCRIPTION OF THE DRAWINGS

These drawings illustrate certain aspects of certain embodiments of the present disclosure. They should not be used to limit or define the disclosure.

Figure 1:
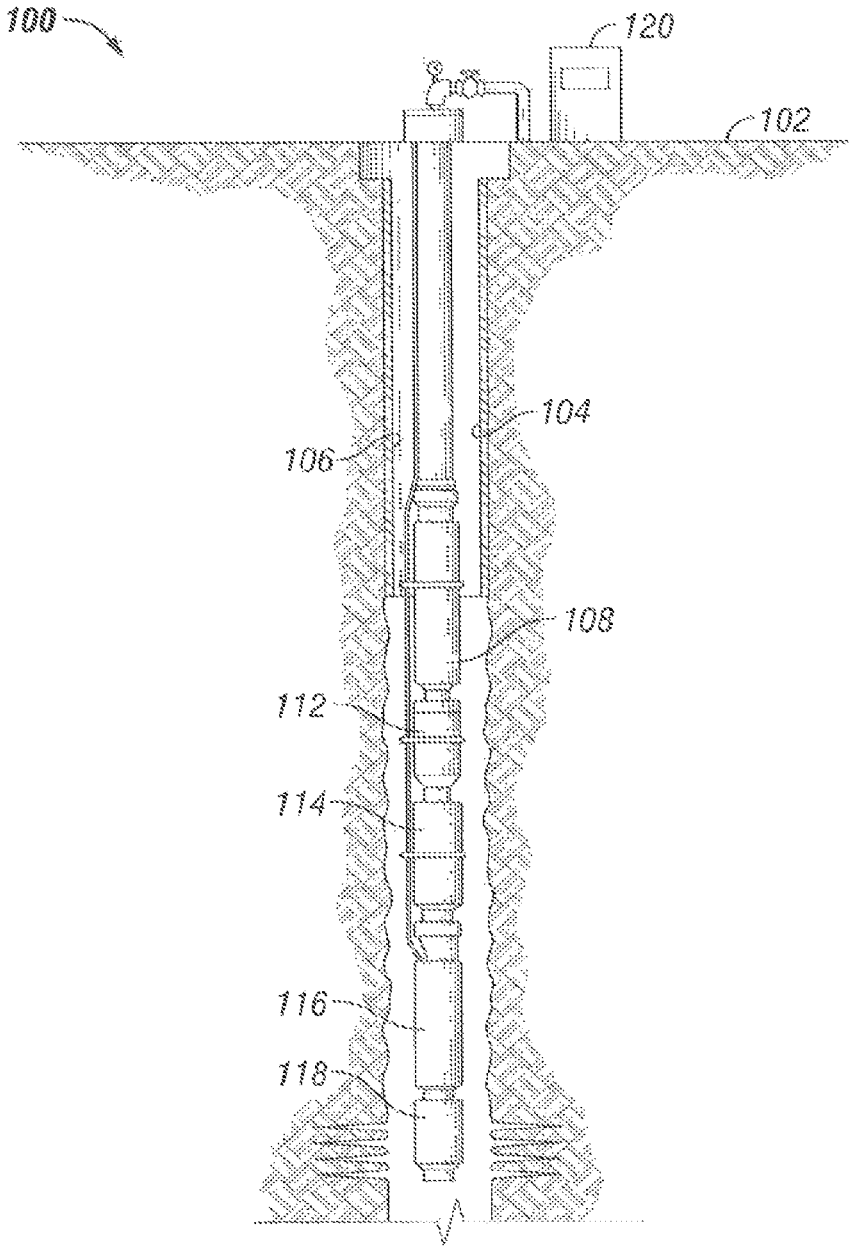
FIG. 1 depicts a schematic partial cross-sectional view of one example pumping system, in accordance with certain embodiments of the present disclosure.

While embodiments of this disclosure have been depicted and described and are defined by reference to example embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

Illustrative embodiments of the present disclosure are described in detail herein. In the interest of clarity, not all features of an actual implementation may be described in this specification. It will of course be appreciated that in the development of any such actual embodiment, numerous implementation-specific decisions may be made to achieve the specific implementation goals, which may vary from one implementation to another. Moreover, it will be appreciated that such a development effort might be complex and time-consuming, but would nevertheless be a routine undertaking for those of ordinary skill in the art having the benefit of the present disclosure.

The terms "couple" or "couples" as used herein are intended to mean either an indirect or a direct connection. Thus, if a first device couples to a second device, that connection may be through a direct connection, or through an indirect electrical or mechanical connection via other devices and connections. The term "upstream" as used herein means along a flow path towards the source of the flow, and the term "downstream" as used herein means along a flow path away from the source of the flow. The term "uphole" as used herein means along the drillstring or the hole from the distal end towards the surface, and "downhole" as used herein means along the drillstring or the hole from the surface towards the distal end.

To facilitate a better understanding of the present disclosure, the following examples of certain embodiments are given. In no way should the following examples be read to limit, or define, the scope of the disclosure. Embodiments of the present disclosure may be applicable to horizontal, vertical, deviated, multilateral, u-tube connection, intersection, bypass (drill around a mid-depth stuck fish and back into the wellbore below), or otherwise nonlinear wellbores in any type of subterranean formation. Certain embodiments may be applicable to subsea and/or deep sea wellbores. Embodiments described below with respect to one implementation are not intended to be limiting.

The present disclosure describes abrasion-resistant thrust rings for use in a downhole electrical submersible pump (ESP). Modern petroleum production operations may use ESPs to pump hydrocarbons from a reservoir to the well surface when the pressure in the reservoir is insufficient to force the hydrocarbons to the well surface. An ESP may include one or more stages, each stage containing an impeller and a diffuser. The impeller and diffuser combinations may increase the velocity and pressure of the hydrocarbon fluid as the fluid travels through the stages of the ESP. The impeller may accelerate the fluid to increase the velocity and kinetic energy of the fluid. The diffuser may transform the kinetic energy of the fluid into potential energy by increasing the pressure of the fluid.

FIG. 1 illustrates an elevation view of an example embodiment of subterranean operations system 100 including ESP 108, in accordance with some embodiments of the present disclosure. In the illustrated embodiment, subterranean operations system 100 may be associated with land-based subterranean operations. However, subterranean operations tools incorporating teachings of the present disclosure may be satisfactorily used with subterranean operations equipment located on offshore platforms, drill ships, semi-submersibles and drilling barges.

Subterranean operations system 100 may include wellbore 104. "Uphole" may be used to refer to a portion of wellbore 104 that is closer to well surface 102 and "downhole" may be used to refer to a portion of wellbore 104 that is further from well surface 102. Wellbore 104 may be defined in part by casing string 106 that may extend from well surface 102 to a selected downhole location. Portions of wellbore 104 that do not include casing string 106 may be described as "open hole."

Various types of hydrocarbons may be pumped from wellbore 104 to well surface 102 through the use of ESP 108. ESP 108 may be a multi-stage centrifugal pump and may function to transfer pressure to the hydrocarbon fluid and/or another type of liquid to propel the fluid from a reservoir to well surface 102 at a desired pumping rate. ESP 108 may transfer pressure to the fluid by adding kinetic energy to the fluid via centrifugal force and converting the kinetic energy to potential energy in the form of pressure. ESP 108 may have any suitable diameter based on the characteristics of the subterranean operation, such as the wellbore size and the desired pumping flow rate. ESP 108 may include one or more pump stages, depending on the pressure and flow requirements of the particular subterranean operation. Each stage of ESP 108 may include one or more impellers and diffusers as discussed in further detail with respect to FIGS. 2 and 3.

A shaft (not expressly shown in FIG. 1) may connect the various components of ESP 108 to other components of the subterranean operation such as intake 112, seal chamber 114, motor 116, and sensor 118. The shaft may have a power cable (not expressly shown) connecting the motor 116 to a controller 120 at a well surface 102. The shaft may transmit the rotation of motor 116 to one or more impellers located in ESP 108 and may cause the impellers to rotate, as discussed further with reference to FIGS. 2 and 3.

Intake 112 may allow fluid to enter the bottom of ESP 108 and flow to the first stage of the ESP 108. Seal chamber 114 may extend the life of the motor by, for example, absorbing axial thrust produced by the ESP 108, dissipating heat created by the thrust produced by the ESP 108, protecting oil for the motor 116 from contamination, and providing pressure equalization between the motor 116 and the wellbore 104.

The motor 116 may operate at high rotational speeds, such as 3,500 revolutions per minute and the rotation of the motor 116 may cause the shaft to rotate. The rotation of the shaft may rotate the impellers inside the ESP 108 and may cause the ESP 108 to pump fluid to the well surface 102. The sensor 118 may include one or more sensors used to monitor the operating parameters of the ESP 108 and/or conditions in the wellbore 104, such as the intake pressure, casing annulus pressure, internal motor temperature, pump discharge pressure and temperature, downhole flow rate, or equipment vibration.

As hydrocarbon fluid travels through the ESP 108, the pressure of fluid may generally increase at each stage due to the fluid traveling through the diffuser. The increase in pressure through each stage of the ESP 108 may result in a downthrust condition. A downthrust condition may exist when the pressure is higher in a subsequent stage of the ESP 108 in the direction of the fluid flow (referred to as a "higher stage") than the pressure in a previous stage of the ESP 108 (referred to as a "lower stage"). In some embodiments, a higher stage may be uphole from a lower stage. This condition may shorten the life of the ESP 200. However, the systems and methods discussed in this disclosure are directed to distributing the forces caused by the downthrust condition in order to extend the life of the ESP 200.

In some circumstances, an upthrust condition may occur. An upthrust condition may exist when the inertial forces of the fluid in ESP 108 toward a higher stage of ESP 108 overcome the downthrust force component. The upthrust condition may force an impeller against a diffuser and may cause damage to the diffuser and/or impeller because ESP 108 may not be designed to endure upthrust conditions and may not have sufficient bearings to support the frictional forces on the components of ESP 108 during upthrust conditions. While ESP 108 may include thrust bearings to reduce friction between the moving components of ESP 108 during downthrust conditions, the thrust bearings may not engage during upthrust conditions and may not reduce friction between the impeller and the diffuser. Additionally, the upthrust condition may cause the impeller and the diffuser to be in direct contact, where the contact may cause abrasive wear as the impeller spins against the diffuser. This condition may also shorten the life of the ESP 200. However, the systems and methods discussed in this disclosure are directed to distributing the forces caused by the upthrust condition in order to extend the life of the ESP 200.

Figure 2:
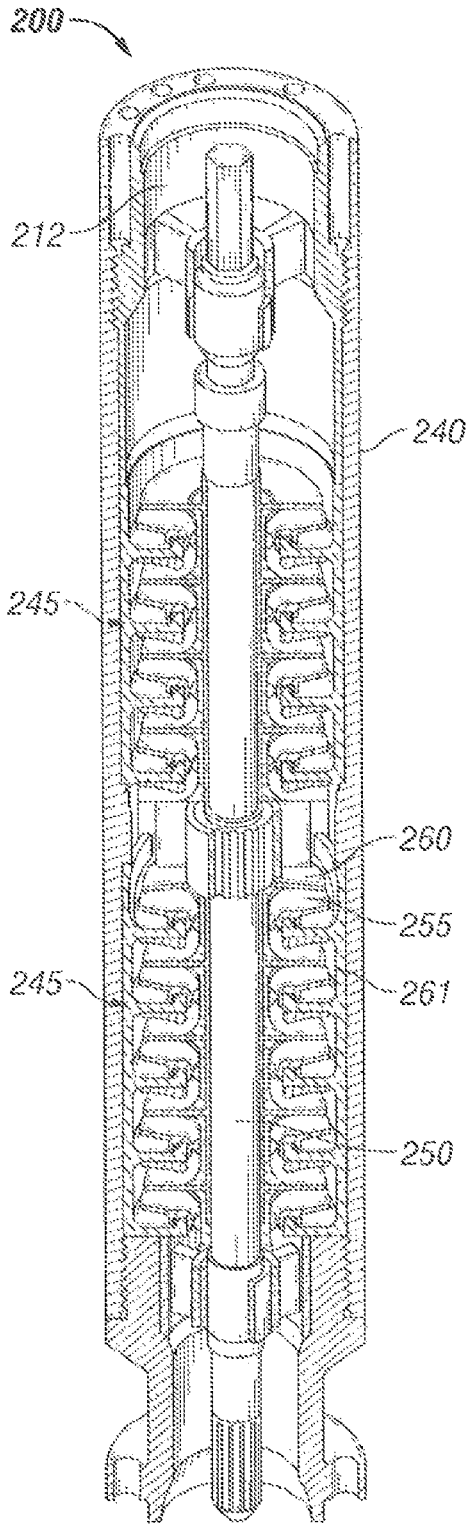
FIG. 2 depicts a schematic partial cross-sectional view of a pump, in accordance with certain embodiments of the present disclosure.

FIG. 2 shows a schematic partial cross-sectional view of an ESP 200, in accordance with certain embodiments of the present disclosure. The ESP 200 may include a housing 240 and a shaft 250 driven by the motor 116. The housing 240 may be a generally cylindrical pump casing of such diameter as to fit within a well borehole for insertion and removal of the ESP 200. The shaft 250 may be an axial drive shaft extending substantially, partially or entirely the length of the ESP 200 and adapted to be driven by a submersible motor located above or below the ESP 200. The shaft 250 may drive a multi-stage pump stack 245. The stages of the multi-stage pump stack 245 may be distributed along the shaft 250. Each stage may include an impeller 255 and a diffuser 260.

Each impeller 255 may be coupled to the shaft 250 for rotation with the shaft 250. Each impeller 255 may include one or more fluid inlets, which may be axial openings proximate to the shaft 250, and one or more curved vanes to form fluid passageways to accelerate fluid with the rotation the shaft 250 and to force the fluid toward a diffuser 260 or another portion of the ESP 200. In certain embodiments, one or more of the impellers 255 may have central hubs to slidingly engage the shaft 250 and to be keyed for rotation with the shaft 250, and each hub may also extend (not shown) to engage an adjacent diffuser 260. In certain embodiments, one or more of the impellers 255 may be free of any physical engagement with the diffusers 260.

Still referring to FIG. 2, the shaft 250 may be used to transfer rotational energy from a motor (such as would be located in motor section 135 of FIG. 1), to the rotational components of a stage, such as the impeller 255. The impeller 255 may be used to increase the velocity and kinetic energy of the fluid as the fluid flows through the stage. Impeller 255 may rotate about the shaft 250. The rotation of impeller 255 may cause the hydrocarbon fluid to accelerate outward from shaft 250 and increase the velocity of the fluid inside the stage. The increased velocity of the fluid may result in the fluid having an increased kinetic energy.

Still referring to FIG. 2, as the fluid exits impeller 255, the fluid may enter diffuser 260. Diffuser 260 may convert the kinetic energy of the fluid into potential energy by gradually slowing the fluid, which increases the pressure of the fluid according to Bernoulli's principle. The increased pressure of the fluid causes the fluid to rise to the well surface, such as well surface 102 shown in FIG. 1.

Still referring to FIG. 2, an impeller 255 and a diffuser 260 may comprise a stage. Each stage of the ESP 200 may be connected in series to achieve a design output pressure of the ESP 200. A multi-stage pump stack 245 may include any number of suitable stages as required by design/implementation requirements. For example, stages may be stacked upon each other to create a required amount of lift for each well. Certain embodiments may include multiple pump stacks 245. And while certain example impeller and diffuser configurations are shown in FIG. 2, those examples should not be seen as limiting. While the ESP 200 is shown in FIG. 2 as having more than one stage, the ESP 200 may also be a single-stage pump. Any suitable impeller and diffuser configuration may be implemented in accordance with certain embodiments of the present disclosure.

Still referring to FIG. 2, one or more of the impellers 255 may be disposed within a diffuser housing 261 of one or more diffusers 260. Each diffuser 260 may be stationary with respect to the casing string 106 and may, for example, be coupled to the housing 240 or supported by another portion of the ESP 200. For example, a diffuser 260 may be supported by inward compression of the housing 240 so as to remain stationary, and a diffuser 260 may have a central bore of such diameter as to allow fluid to travel upward through the annulus between said central bore and the shaft 250 and into the impeller intake. In certain embodiments, the diffuser 260 may aid radial alignment of the shaft. Each diffuser 260 may include one or more inlets to receive fluid from an adjacent impeller 250. One or more cylindrical surfaces and radial vanes of a diffuser 260 may be formed to direct fluid flow to the next stage or portion of the ESP 200.

Still referring to FIG. 2, after traveling through the stages of the ESP 200, the fluid may exit the ESP 200 at a discharge head 212. In some embodiments, the discharge head 212 may be coupled to production tubing which may be used to direct the flow of fluid from the wellbore to the well surface. The housing 240 may surround the components of ESP 200 and may align the components of ESP 200.

Figure 3A:
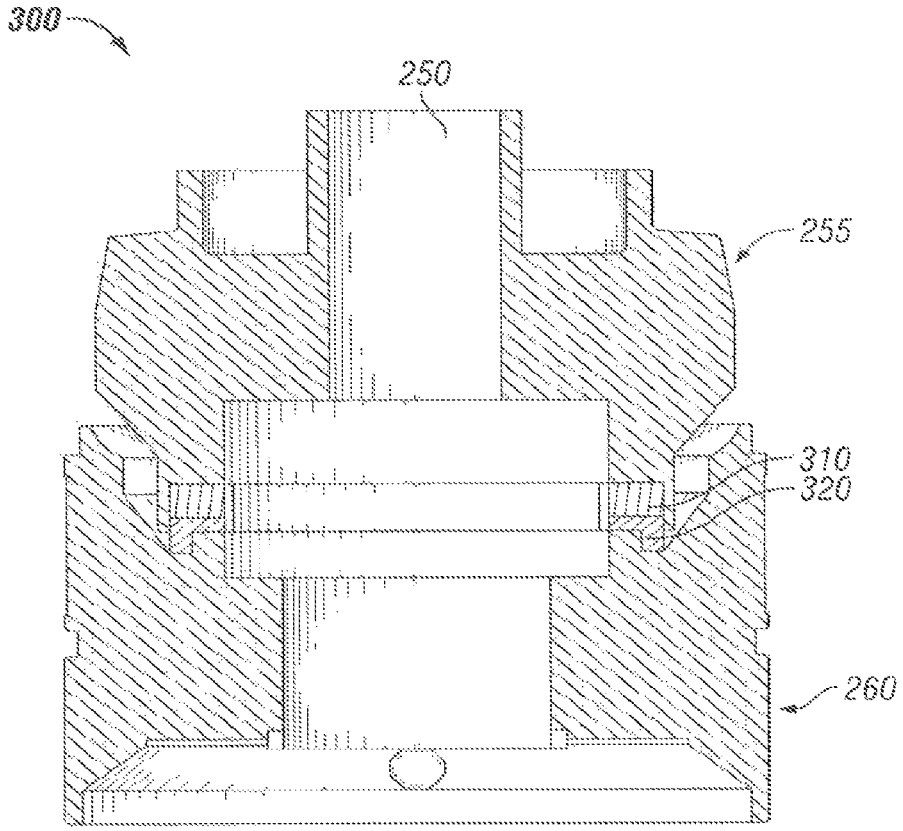
FIGS. 3A-3E depict a stage (or portions thereof) in accordance with certain embodiments of the present disclosure.
Figure 3B:
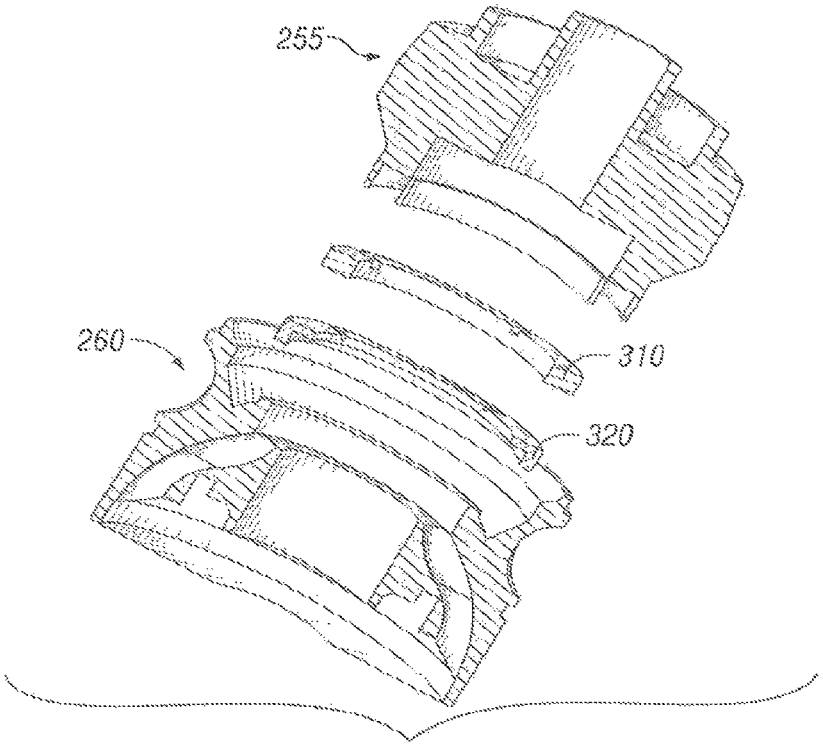
Figure 3C:
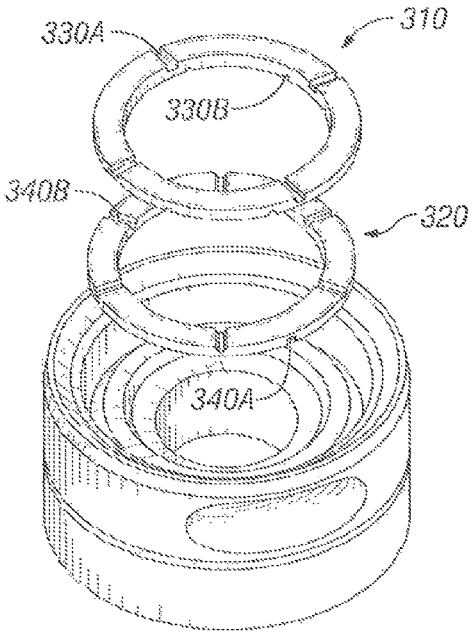
Figure 3D:
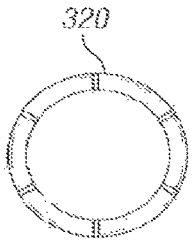
Figure 3E:
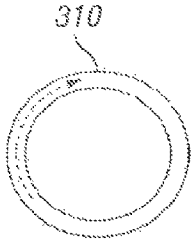

FIGS. 3A and 3B depict a stage 300. A plurality of stages 300 may be included in a multi-stage pump stack 245. Each stage 300 may include an impeller 255 and diffuser 260. The diffuser 260 may be disposed about the shaft 250. The impeller 255 may be disposed within the diffuser 260. The impeller 255 may include a first thrust ring 310, which may be operable to rotate with the impeller 255. In certain embodiments, the first thrust ring 310 may include an anti-rotation feature to enable it to rotate with the impeller 355. For example, the first thrust ring may include a first grooved surface 330*a*. The first grooved surface 330*a* may be operable to provide an anti-rotation feature with respect to the impeller 255. In other embodiments, the first thrust ring 310 may be coupled to the impeller 255. The diffuser 260 may include a second thrust ring 320. The second thrust ring 320 may also include a first grooved surface 340*a*. In certain embodiments, the diffuser 260 and second thrust ring 320 may be stationary and may not be operable to rotate. The first thrust ring 310 and the second thrust ring 320 may be made of a material with a low friction coefficient, such as a ceramic, carbide, nylon, HDPE, or PTFE material. However, this disclosure is not intended to limit the first and second thrust rings 310 and 320 to a ceramic material, and any material with a low friction coefficient may be used without limiting the scope of this disclosure. Further, either or both of the first and second thrust rings 310 and 320 may be manufactured in a single piece or may be manufactured using multiple pieces that are fit together without limiting the scope of this disclosure.

The first and second thrust rings 310 and 320 may prevent the impeller 255 and the diffuser 260 from contacting each other directly, thus preventing undesirable metal-to-metal contact. Thus, the first and second thrust rings 310 and 320 may be operable to extend the life of the multi-stage pump stack 245. In certain embodiments, the first and second thrust rings 310 and 320 may each include a second grooved surface 330*b* and 340*b*, respectively. The second grooved surfaces 330*b* and 340*b* of the first and second thrust rings may contact each other during operation. In operation, debris may wear on the surface of the thrust rings 310 and 320. The second grooved surfaces 330*b* and 340*b* may operate to reduce the friction on the surfaces of the thrust rings 310 and 320 and may help eliminate debris that remains on the surfaces of the thrust rings 310 and 320 so as to reduce the wear on the thrust rings 310 and 320. Specifically, the thrust rings 310 and 320 may be operable to expel debris on their surfaces by pushing the debris into the grooves and forcing it outward through the rotation of the first thrust ring 310. Additionally, the second grooved surfaces 330*b* and 340*b* may be operable to lubricate the thrust rings 310 and 320 as fluid may be able to enter into and pass through the grooves. In this way, the life of the thrust rings 310 and 320 may be prolonged.

During operation of the ESP 200, forces operate on the impeller 255 and the diffuser 260, including downthrust and upthrust forces. For example, forces from the suction and discharge pressures may act on the impeller 255. Additionally, there may be an axial load due to the pump discharge pressure acting on the cross-sectional area of the pump shaft. However, as described herein, the ESP 200 may be operable to distribute the forces between the first and second thrust rings 310 and 320, thus extending the life of the ESP 200. Further, the first and second thrust rings 310 and 320 may be included in more than one stage 300 within the ESP 200. Thus, the force may be distributed among a plurality of first and second thrust rings 310 and 320. Thus, the first thrust ring 310 and second thrust ring 320 may be operable to prolong the life of the impellers 255, diffusers 260, and the multi-stage pump stack 245.

One embodiment is a multi-stage pump stack including: a shaft, a diffuser disposed about the shaft, an impeller disposed within the diffuser, a first thrust ring disposed adjacent to the impeller, and a second thrust ring disposed adjacent to the diffuser, wherein the first and second thrust rings are comprised of a material with a low friction coefficient.

Optionally, the first thrust ring may be operable to rotate and the second thrust ring may not be operable to rotate.

Optionally, the first and second thrust rings may be comprised of a ceramic material.

Optionally, the first thrust ring may include a first grooved surface, and the first grooved surface may be disposed adjacent to the impeller.

Optionally, the first and second thrust rings may each include a second grooved surface, and the second grooved surfaces may contact each other.

Optionally, the first and second thrust rings may be operable to prevent direct contact between the impeller and diffuser.

Optionally, downthrust forces may be distributed between the first and second thrust rings.

Optionally, upthrust forces may be distributed between the first and second thrust rings.

Another embodiment is a multi-stage pump stack including: a shaft, a first diffuser disposed about the shaft, a first impeller disposed within the first diffuser, a first thrust ring disposed adjacent to the first impeller and comprised of a material with a low friction coefficient, a second thrust ring disposed adjacent to the first diffuser and comprised of a material with a low friction coefficient, a second diffuser disposed about the shaft and adjacent to the first diffuser, and a second impeller disposed within the second diffuser.

Optionally, the first thrust ring may be operable to rotate and the second thrust ring may not be operable to rotate.

Optionally, the first and second thrust rings may be comprised of a ceramic material.

Optionally, the first and second thrust rings may each include a first grooved surface.

Optionally, the first and second thrust rings may each comprise a second grooved surface, and the second grooved surfaces may contact each other.

Optionally, the first and second thrust rings may be operable to prevent direct contact between the first impeller and first diffuser.

Another embodiment is a method for distributing force in a multi-stage pump stack, including: assembling a stage comprising an impeller and a diffuser, wherein the impeller is disposed within the diffuser, rotating the impeller and a first thrust ring, wherein the first thrust ring is disposed adjacent to the impeller, and maintaining the diffuser and a second thrust ring in a stationary position, where the second thrust ring is disposed adjacent to the diffuser, and where the first and second thrust rings are comprised of a material with a low friction coefficient.

Optionally, the first and second thrust rings may be comprised of a ceramic material.

Optionally, the first thrust ring may include a first grooved surface.

Optionally, the first thrust ring may include a second grooved surface.

Optionally, the method may further include expelling debris from a surface of each of the first and second thrust rings.

Optionally, the method may further include lubricating a surface of each of the first and second thrust rings.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present disclosure. Also, the terms in the claims have their plain, ordinary meaning unless otherwise explicitly and clearly defined by the patentee.

What is claimed is:

1. A multi-stage pump stack comprising:

a shaft;

a diffuser disposed about the shaft;

an impeller disposed within the diffuser, wherein the impeller is provided with a concentric channel disposed about the circumference of the impeller at one end of the impeller, wherein the one end is inserted into the diffuser;

a first thrust ring disposed within the impeller, wherein the first thrust ring comprises a first grooved surface and a second grooved surface, wherein the first thrust ring is disposed within the channel; and a second thrust ring disposed within the diffuser and adjacent to the first thrust ring, wherein the second thrust ring is at least partially disposed within the channel of the impeller, wherein the second thrust ring comprises a first grooved surface, wherein the first grooved surface of the first thrust ring contacts the first grooved surface of the second thrust ring, wherein the second thrust ring comprises an L-shaped cross-section, wherein the first and second thrust rings are comprised of a material with a low friction coefficient, wherein the material with a low friction coefficient is selected from the group consisting of: carbide, ceramic, nylon, HDPE, and PTFE; and wherein upthrust forces are distributed between the first and second thrust rings.

2. The multi-stage pump stack of claim 1, wherein the first thrust ring is operable to rotate and wherein the second thrust ring is not operable to rotate.

3. The multi-stage pump stack of claim 1, wherein the second grooved surface of the first thrust ring is disposed adjacent to the impeller.

4. The multi-stage pump stack of claim 1, wherein the first and second thrust rings are operable to prevent direct contact between the impeller and diffuser.

5. The multi-stage pump stack of claim 1, wherein downthrust forces are distributed between the first and second thrust rings.

6. A multi-stage pump stack comprising:

a shaft;

a first diffuser disposed about the shaft;

a first impeller disposed within the first diffuser, wherein the first impeller is provided with a concentric channel disposed about the circumference of the first impeller at one end of the first impeller, wherein the one end is inserted into the first diffuser;

a first thrust ring disposed within the first impeller and comprised of a material with a low friction coefficient, wherein the first thrust ring comprises a first grooved surface and a second grooved surface, wherein the first thrust ring is disposed within the channel;

a second thrust ring disposed within the first diffuser and adjacent to the first thrust ring and comprised of a material with a low friction coefficient, wherein the material with a low friction coefficient is selected from the group consisting of: carbide, ceramic, nylon, HDPE, and PTFE, wherein the second thrust ring is at least partially disposed within the channel of the first impeller, wherein the second thrust ring comprises a first grooved surface, wherein the first grooved surface of the first thrust ring contacts the first grooved surface of the second thrust ring, wherein the second thrust ring comprises an L-shaped cross-section, and wherein upthrust forces are distributed between the first and second thrust rings;

a second diffuser disposed about the shaft and adjacent to the first diffuser; and a second impeller disposed within the second diffuser.

7. The multi-stage pump stack of claim 6, wherein the first thrust ring is operable to rotate and wherein the second thrust ring is not operable to rotate.

8. The multi-stage pump stack of claim 6, wherein the second grooved surface of the first thrust ring is disposed adjacent to the impeller.

9. The multi-stage pump stack of claim 6, wherein the first and second thrust rings are operable to prevent direct contact between the first impeller and first diffuser.

10. A method for distributing force in a multi-stage pump stack comprising:

assembling a stage comprising an impeller and a diffuser, wherein the impeller is disposed within the diffuser, wherein the impeller is provided with a concentric channel disposed about the circumference of the impeller at one end of the impeller, wherein the one end is inserted into the diffuser, rotating the impeller and a first thrust ring, wherein the first thrust ring is disposed within the channel of the impeller;

maintaining the diffuser and a second thrust ring in a stationary position, wherein the second thrust ring is disposed within the diffuser and adjacent to the first thrust ring, wherein the second thrust ring is at least partially disposed within the channel of the impeller, wherein the second thrust ring comprises an L-shaped cross-section, wherein the first thrust ring comprises a first grooved surface and a second grooved surface, wherein the second thrust ring comprises a first grooved surface, wherein the first grooved surface of the first thrust ring contacts the first grooved surface of the second thrust ring, wherein the first and second thrust rings are comprised of a material with a low friction coefficient, wherein the material with a low friction coefficient is selected from the group consisting of: carbide, ceramic, nylon, HDPE, and PTFE, and wherein upthrust forces are distributed between the first and second thrust rings.

11. The method of claim 10, wherein the second grooved surface of the first thrust ring is disposed adjacent to the impeller.

12. The method of claim 10, further comprising:

expelling debris from a surface of each of the first and second thrust rings.

13. The method of claim 10, further comprising:

lubricating a surface of each of the first and second thrust rings.

* * * * *